US008822860B2

(12) United States Patent
Specht et al.

(10) Patent No.: US 8,822,860 B2
(45) Date of Patent: Sep. 2, 2014

(54) PUSH BUTTON SWITCH ASSEMBLY

(75) Inventors: Trevor Specht, Ansbach (DE); Heiko Meissner, Ansbach (DE)

(73) Assignee: Electrolux Home Products Corporation N.V., Brussels (BE)

( * ) Notice: Subject to any disclaimer, the term of this patent is extended or adjusted under 35 U.S.C. 154(b) by 9 days.

(21) Appl. No.: 13/376,866

(22) PCT Filed: Jul. 12, 2010

(86) PCT No.: PCT/EP2010/004215

§ 371 (c)(1),
(2), (4) Date: Dec. 8, 2011

(87) PCT Pub. No.: WO2011/012218

PCT Pub. Date: Feb. 3, 2011

(65) Prior Publication Data

US 2012/0111705 A1 May 10, 2012

(30) Foreign Application Priority Data

Jul. 29, 2009 (DE) ..... 20 2009 010 291 U
Jul. 29, 2009 (DE) ..... 20 2009 010 292 U
Mar. 25, 2010 (EP) ..... 10003183

(51) Int. Cl.
*H01H 13/70* (2006.01)

(52) U.S. Cl.
USPC ..... 200/344

(58) Field of Classification Search
USPC ..... 200/344, 5 R, 5 A, 50.01, 50.02, 50.36, 200/520, 329, 337, 338, 341, 345
See application file for complete search history.

(56) References Cited

U.S. PATENT DOCUMENTS 4,066,860 A * 1/1978 Kawasaki ..... 200/308
4,463,237 A 7/1984 Kim

FOREIGN PATENT DOCUMENTS

DE 8510147 5/1987
FR 2785493 5/2000
WO 2004057135 7/2004

OTHER PUBLICATIONS

International Search Report for PCT/EP2010/004215, dated Oct. 25, 2010, 2 pages.

* cited by examiner

*Primary Examiner* — Edwin A. Leon
*Assistant Examiner* — Anthony R. Jimenez
(74) *Attorney, Agent, or Firm* — Pearne & Gordon LLP

(57) ABSTRACT

Push button switch assembly, in particular for insertion in a control panel of a domestic appliance, the push button switch assembly comprising at least one push button and a frame for receiving the at least one push button, wherein the push button has a push button cap, whose top wall or rather upper side is to be manipulated by a user, and an actuating element, in particular an actuating pin, for actuating a switch, especially a micro switch, of a circuit board arranged underneath the push button switch assembly upon actuation of the push button cap, wherein the push button cap is provided with spring legs resting on a frame bottom and counteracting the actuation of the push button cap, characterized in that at least two spring legs are provided, which are formed in a rotationally symmetric or in an axially symmetric arrangement at the push button cap.

13 Claims, 7 Drawing Sheets

PUSH BUTTON SWITCH ASSEMBLY

The present invention relates to a push button switch assembly, in particular for insertion in a control panel of a domestic appliance, the push button assembly comprising at least one push button and a frame for receiving the at least one push button, wherein the push button has a push button cap, whose top wall or rather upper side is to be manipulated by a user, and an actuating element, in particular an actuating pin, for actuating a switch, especially a micro switch, of a circuit board arranged underneath the push button switch assembly upon actuation of the push button cap, wherein the push button cap is provided with spring legs resting on a frame bottom and counteracting the actuation of the push button cap.

Control panels of domestic appliances normally comprise a plurality of different operational controls for setting specific functions, for example push buttons or the like. Such push buttons may be arranged separately or side by side in order to define a push button panel. It is important, that the functional units are spatially adjusted to one another such that the push buttons arranged at the operating panel and the electric switching elements positioned underneath the control panel cooperate without any problems.

One known push button switch assembly is described in EP-A-1 482527. This push button switch assembly comprises several push buttons each having a push button cap and an actuating element in the form of an actuating pin, whereas the push button cap and the actuating element are formed as a one-piece component. The actuating elements extend from the assigned push button cap towards an electric switching element of the domestic appliance in order to effect a switching operation upon actuation of the push button cap. The push buttons are received and guided by a frame, which in turn is fixed to the control panel of the appliance. In order to move the push buttons back in their initial position after actuation, each actuation element cooperates with a silicone mat with carbon pill, which generates the necessary restoring force.

One drawback of the one-piece design of the push buttons of the push button switch assembly according to EP-A-1482527 is that sink marks are created on the visual surface of the push button caps during their manufacture. This is not desirable for optical reasons. Moreover, the silicone mat cannot compensate deviations in position of the push buttons due to manufacturing tolerances of the control panel and/or the push buttons and/or the frame and/or the switching. This may lead in worst case to disturbances of the appearance as well as to rattle noises.

In order to overcome the mentioned drawbacks, EP-A-1467390 proposes to provide the push button cap and the actuating element of each push button as separate components, wherein each push button cap is formed with two spring legs, which rest on the frame and create the restoring force necessary to move the push button cap back in its initial poison after actuation.

However, the two-part design of the push button as proposed in EP-A-1467390 leads to an undefined and alterable position of the actuating element between the frame and the electric switching element. Thus, an accurate and stable position of the actuating element relative to the tactile switches on the electronic board cannot be ensured. Moreover the undefined position of the actuating element can lead to an unwanted rattle. In addition, due to the asymmetric design of its two spring legs a rocking over the diagonal of the top wall of the push button cap is possible, what is not desirable in regard to haptics.

Starting from this prior art it is an object of the present invention to provide a push button assembly of the above-mentioned kind, which overcomes or reduces the described drawbacks.

This object is solved by providing a push button switch assembly, in particular for insertion in a control panel of a domestic appliance, the push button switch assembly comprising at least one push button and a frame for receiving the at least one push button, wherein the push button has a push button cap, whose top wall or rather upper side is to be manipulated by a user, and an actuating element, in particular an actuating pin, for actuating a switch, especially a micro switch, of a circuit board arranged underneath the push button switch assembly upon actuation of the push button cap, wherein the push button cap is provided with spring legs resting on a frame bottom and counteracting the actuation of the push button cap, wherein at least two spring legs are provided, which are formed in a point symmetric or in an axially symmetric arrangement at the push button cap. Thanks to this symmetric push button cap design the push button cap of the at least one push button is held in a defined position. This promotes the appearance of the push button switch assembly, in particular if the push button assembly comprises more than one push button, because the push button caps can be properly aligned with each other. Moreover, the symmetric push button design leads to a very good position stability of the push button cap, so that a rocking over the diagonal of the top wall of the push button cap is no longer possible, what is desirable in regard to haptics.

The push button cap and the actuating element are formed as a one-piece component. Thus, no or at least nearly no rattle can occur due to an undefined position of the actuating element. Moreover, the total number of components is reduced, what is advantageous in regard to the manufacture and assembly of the push button switch assembly. Furthermore, the loading of the circuit board generated by the actuating element is adjustable by means of the spring legs of the push button cap. Thus, no additional load adjusting means need to be provided. Preferably, the push button cap, the actuating element and the spring legs are formed as a one-piece component. By this, the above named aspects can be improved further.

The actuating element is advantageously formed at a position spaced apart from the top wall of the push button cap in order to prevent the formation of sink marks on the visible surface of the push button during its manufacture. Preferably, a clearance is formed between the beginning of the actuating element and the top wall of the push button cap.

The forces of the spring legs, that counteract the actuation of the push button cap, can be adjusted by material and/or geometry variation. Thus, the actuating and return forces can be set, e.g. in order to prevent an overloading of the circuit board.

Ribs are provided at the inside of the frame and/or at the push button cap for fixation or positioning of the push button cap. By means of such ribs a fine-tuning in regard to fixation and orientation of the push buttons is possible.

The ribs at the frame and the ribs at the push button cap are preferably matched with each other.

According to one aspect of the present invention, at least a second push button is provided and ribs are asymmetrically arranged at opposite sidewalls of the push button caps.

The asymmetrical arrangement of the ribs is preferably chosen in such a manner, that the push button caps can also be assembled in a state rotated by 180°. This simplifies the assembly.

Preferably, at least two push buttons are arranged in a length-wise row, wherein push button positioning means, which correspond to the ribs formed at the push buttons, are provided at the short sides at the frame.

At each of the length-wise sidewalls of the frame fixing means can be formed for a proper assembly of the push button switch assembly in an opening of a control panel of a domestic appliance.

Preferably, four or at least four spring legs are provided, which are formed in a point symmetric or in an axially symmetric arrangement at the push button cap. This enables or improves a uniform guidance of the push button cap.

Preferably, two spring legs are formed at the bottom wall on each of the opposite sides of the actuation element and/or the spring legs are arranged as at least one pair, wherein preferably the spring legs of a or each pair extend downwards in opposed directions, respectively, such that the or each pair of spring legs describes an inverted V-shape. This can ease the manufacturing of the legs, as no separate parts are necessary.

In the following an embodiment of a push button switch assembly according to the present invention for insertion in a control panel of a domestic appliance will be described with reference to the accompanying drawings, wherein FIG. 1 is a perspective view of a push button of a push button switch assembly according to an embodiment of the present invention;

Figure 1:
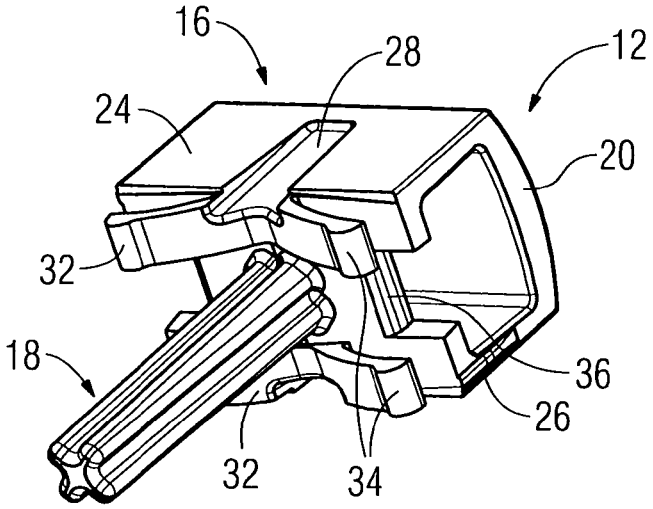
Figure 2:
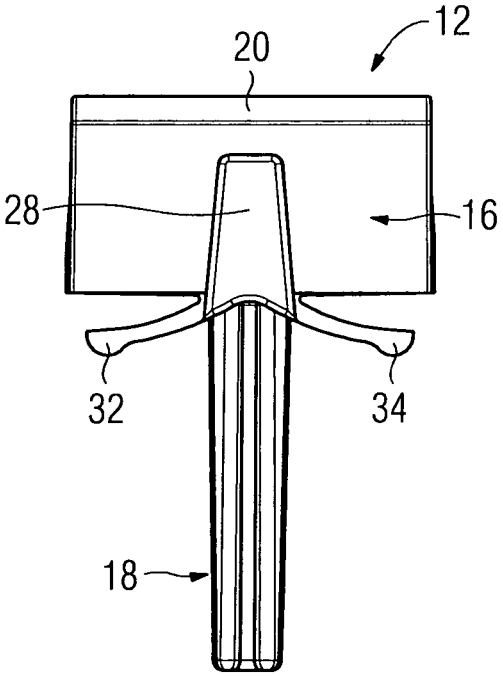
FIG. 2 is a front view of the push button.
Figure 3:
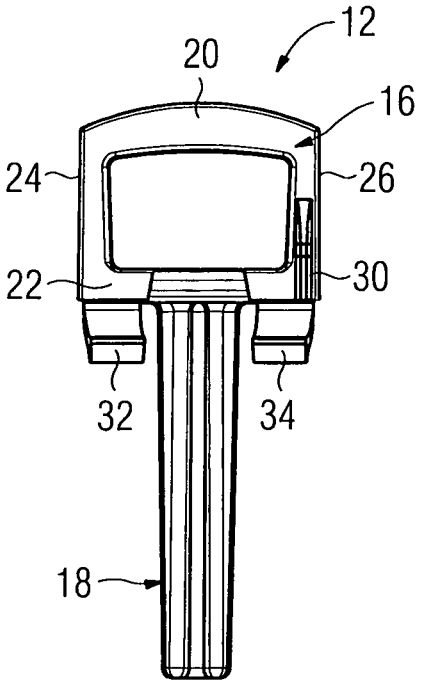
FIG. 3 is a side view of the push button.
Figure 4:
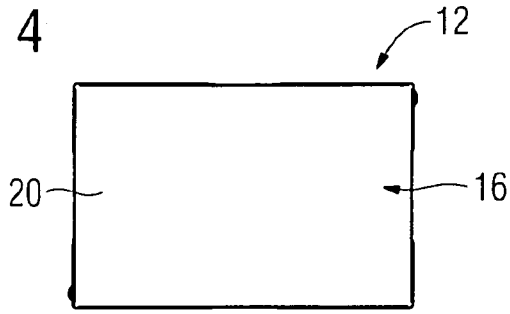
FIG. 4 is a top view of the push button.
Figure 5:
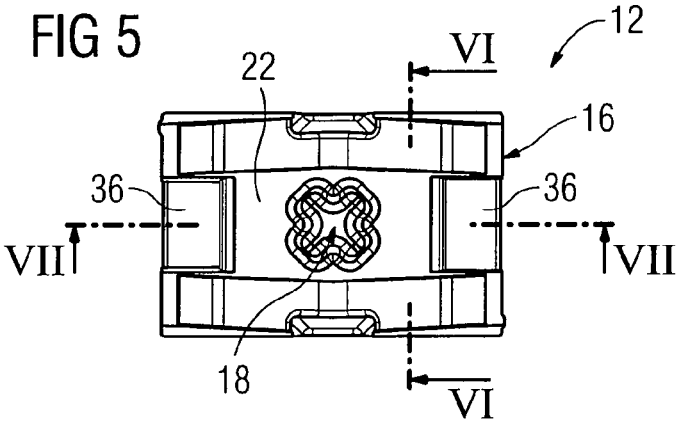
FIG. 5 is a bottom view of the push button.
Figure 6:
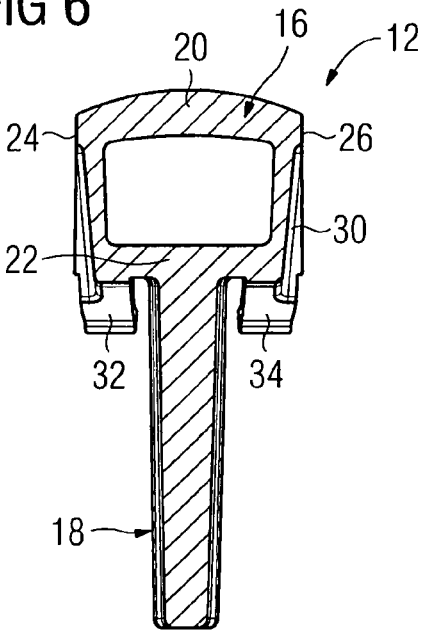
FIG. 6 is a sectional view of the push button along line VI-VI in FIG. 5.
Figure 7:
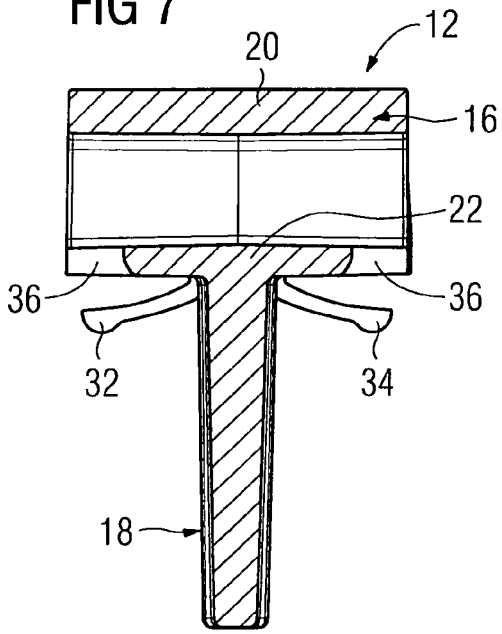
FIG. 7 is a sectional view of the push button along line VII-VII in FIG. 5.
Figure 8:
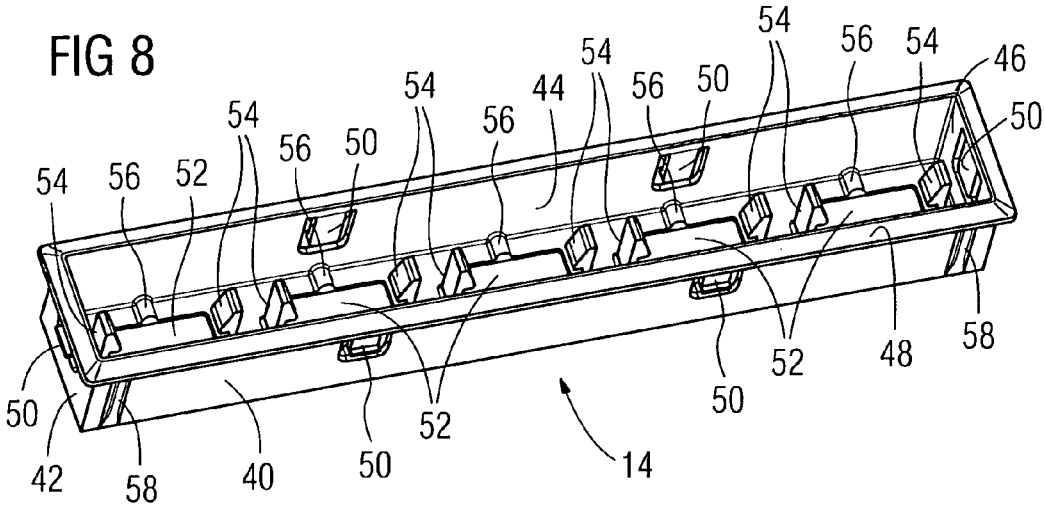
FIG. 8 is a perspective view of the frame of the push button switch assembly.
Figure 9:
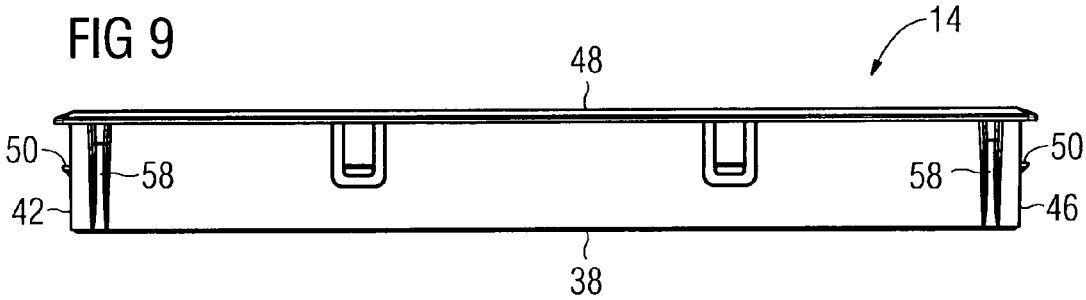
FIG. 9 is a front view of the frame.
Figure 10:
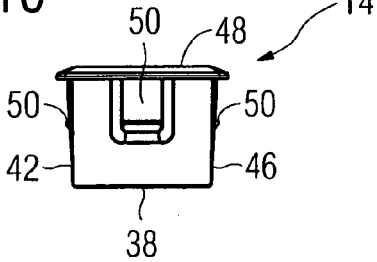
FIG. 10 is a side view of the frame.
Figure 11:
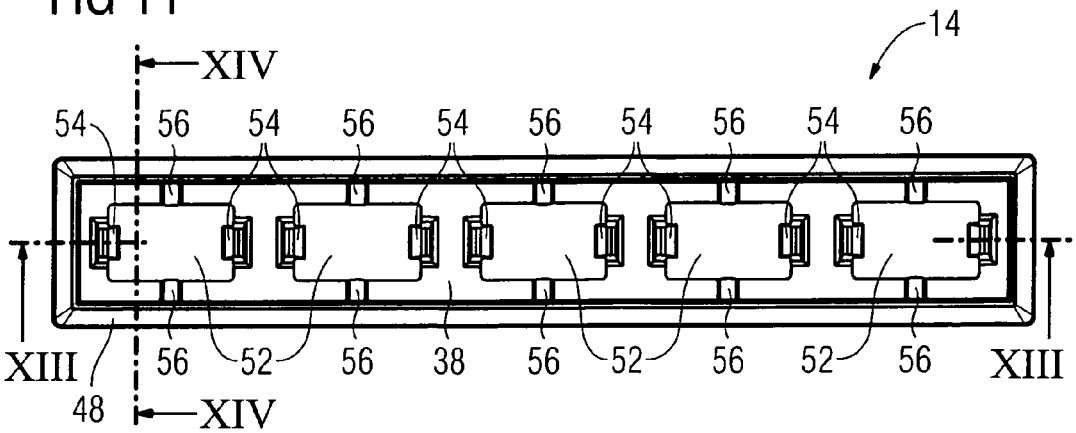
FIG. 11 is a top view of the frame.
Figure 12:
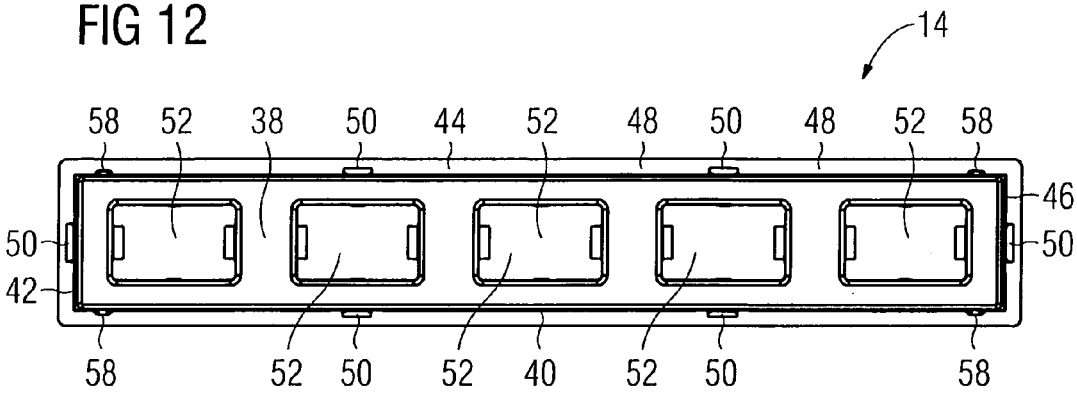
FIG. 12 is a bottom view of the frame.
Figure 13:
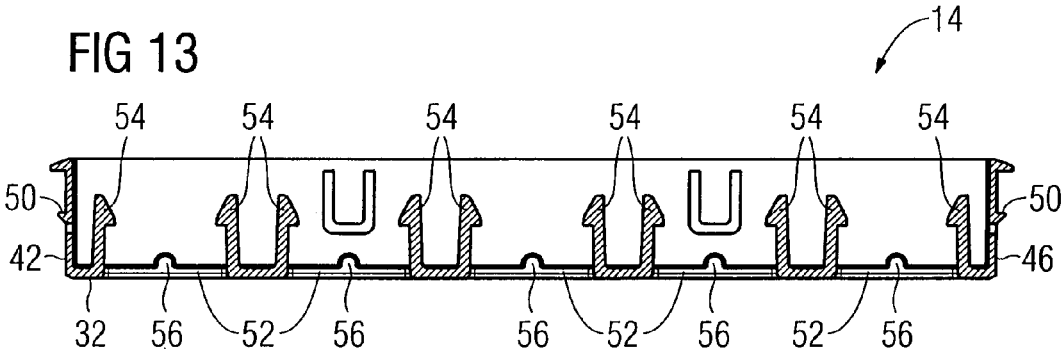
FIG. 13 is a sectional front view of the frame along line XIII-XIII in FIG. 11.
Figure 14:
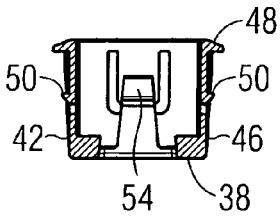
FIG. 14 is a sectional front view of the frame along line XIV-XIV in FIG. 11.
Figure 15:
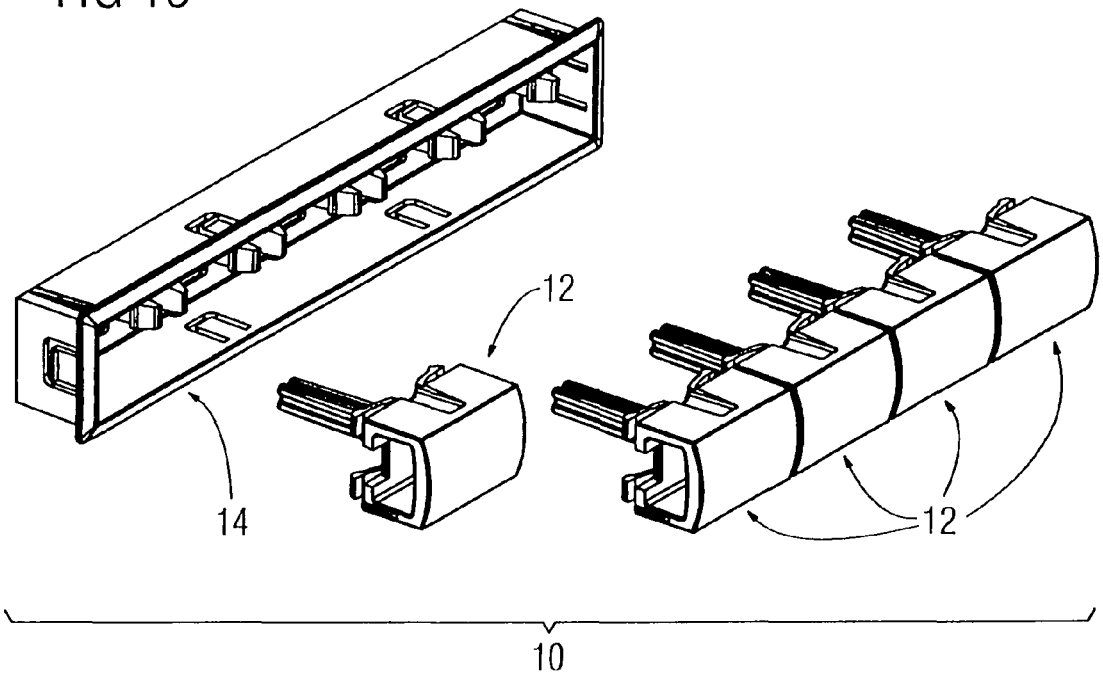
FIG. 15 is an exploded view of the push button switch assembly.
Figure 16:
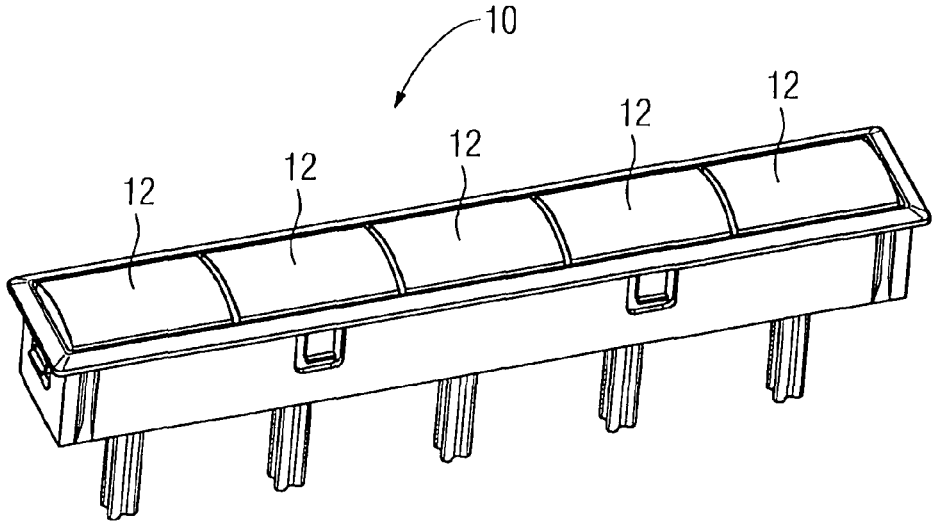
FIG. 16 is a perspective view of the assembled push button switch assembly.
Figure 17:
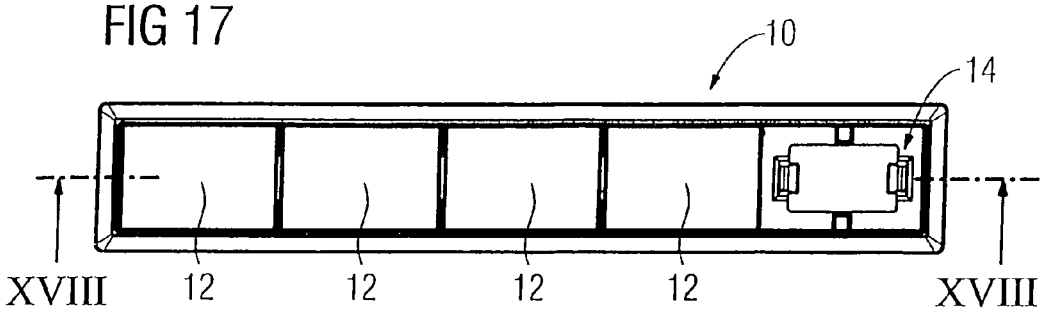
FIG. 17 is a top view of the assembled push button switch assembly with one push button missing.
Figure 18:
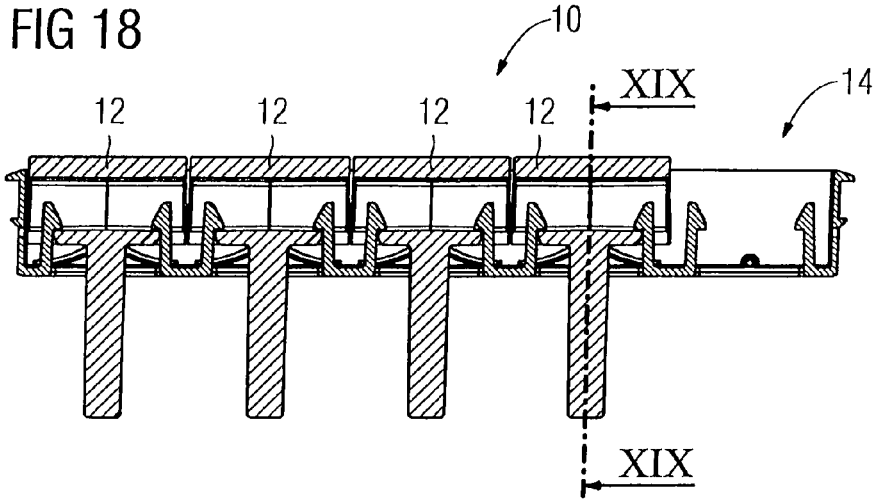
FIG. 18 is a sectional view of the assembled push button switch assembly along line XVIII-XVIII in FIG. 17.
Figure 19:
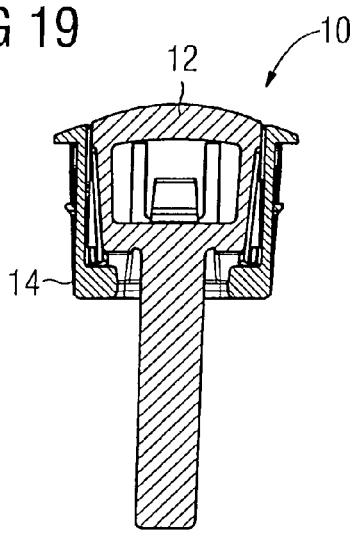
FIG. 19 is an enlarged sectional view of the assembled push button switch assembly along line XIX-XIX in FIG. 18.

FIGS. 1 to 20 show a push button switch assembly 10 according to an embodiment of the present invention and different views of its components. The push button switch assembly 10 is to be inserted in a control panel (not shown) of a domestic appliance, in particular in a control panel made of glass, metal, plastic or another material having similar characteristics. As main components the push button switch assembly 10 comprises five identically formed push buttons 12 and a frame 14 for receiving the five push buttons 12 and for guiding their movements upon actuation.

One push button 12 is shown in detail throughout FIGS. 1 to 7. The push button 12 is formed as a one-piece component and comprises a push button cap 16 and an actuating element 18. The push button cap 16 essentially has the form of a square tube and has a top wall 20, a bottom wall 22 and two opposed sidewalls 24 and 26. The top wall 20, whose upper side is to be manipulated by a user, is dome-shaped. Each sidewall 24 and 26 is formed with a slit 28, which extends between the bottom wall 22 and the top wall 20 and is open towards the bottom wall 22. One of the two face surfaces of each sidewall 24 and 26 is provided with a rib 30 in such a manner, that the two ribs are arranged diagonally opposed. The actuation element 18 is connected to the center portion of the planar bottom wall 22. Two spring legs 32 and 34 are formed at the bottom wall 22 on each of the opposite sides of the actuation element 18 underneath the slits 28. The spring legs 32 and 34 extend downwards in opposed directions, respectively, such that each pair of spring legs 32 and 34 describes an inverted V-shape. At the other two opposite sides of the actuation element 18, the bottom wall 22 is formed with an one-sided open clamping recess 36, respectively. The actuating element 18 has a cruciform cross section and extends from the bottom wall 22 of the push button cap 16 at right angle.

Figure 20:
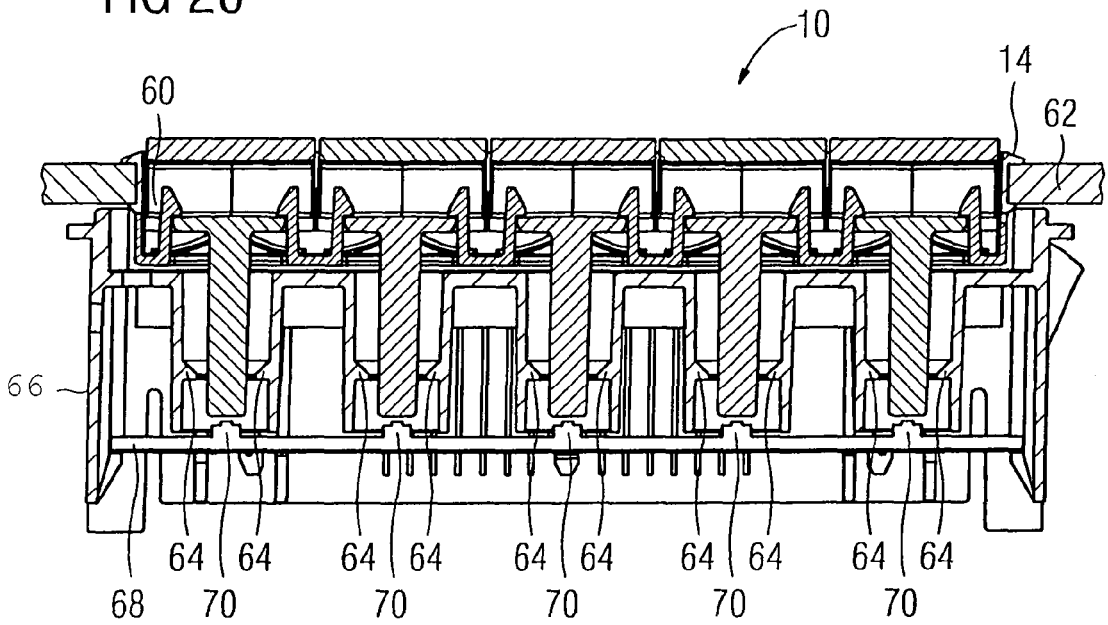
FIG. 20 is a sectional view of the assembled push button switch assembly, which is inserted in a control panel of a domestic appliance.

The frame 14, which is shown in detail throughout FIGS. 8 to 14, has a longitudinal shape and is designed to receive the five push buttons 12. The frame 14 comprises a frame bottom wall 38 as well as four frame sidewalls 40, 42, 44 and 46, which are provided at their upper ends with a circumferential edge 48, that rests—when received in an opening of a control panel—on the outer side of the control panel as shown in FIG. 20. At the lower end of the frame sidewalls 40, 42, 44 and 46 fixing means 50 in the form of snap arms are provided, which snap behind the bottom face of the control panel during the assembly of the frame 14. The distance between the circumferential edge 48 and the fixing means 50 is chosen in such a manner that a clamping force is created between the frame 14 and the control panel in the inserted state of the frame 14. In order to receive the actuating elements 18 of the five push buttons 12, five openings 52 are formed in the frame bottom wall 38 in equal intervals and in alignment with each other. At each of two opposing sides of each opening 52 an upwardly extending snap arm 54 is provided, whereas the two snap arms 54 of each opening 52 engage the clamping recesses 36 of a push button cap 16 of an assigned push button 12 in the assembled state of the push button switch assembly 10. Accordingly, the frame 14 comprises a total of ten aligned snap arms 54. At the other two opposing sides of each opening 52, inner ribs 56 are formed, which are matched with the slits 28 formed in the sidewalls 24 and 26 of each push button cap 16 and received therein in the assembled state of the push button switch assembly 10. In order to achieve a good fit of the frame 14 within an opening of a control panel of a domestic appliance, the longish frame sidewalls 40 and 44 are provided with outer ribs 58, which extend upwards from the frame bottom wall 38.

During the assembly of the push button switch assembly 10, the frame 14 is pushed into an opening 60 of a control panel 62 from above at first, such that the fixing means 50 of the frame 14 snap behind the bottom face of the control panel 62 and the circumferential edge 48 rests on the top face of the control panel 62. In this state, a close fit between the frame 14 and the control panel 62 is ensured by means of the outer ribs 58 of the frame 14. Thereafter, the actuating elements 18 of the push buttons 12 are inserted in the assigned openings 52 of the frame 14. During this insertion movement, the snap arms 54 upwardly protruding from the frame bottom wall 38 are received in the clamping recesses 36 of the assigned push buttons 12, until the push button caps 12 are snap-fittingly held at the frame 14. In this state, the spring legs 32, 34 of the push buttons 12 rest on the frame bottom wall 38 with little pretension, such that the upper sides of all five push buttons 12 are arranged on the same level. Moreover, the inner ribs 56 of the frame 14 are received in the slits 28 of the push button caps 16. Furthermore, the single push buttons 12 are oriented with respect to each other by means of the ribs 30 provided on the face surfaces of the push button caps 16. As shown in FIG. 20, the actuating element 18 of each push button 12 is also received and guided in a guiding structure 64 of a housing 66, which is arranged between the control panel 62 and a circuit board 68 comprising the micro switches 70 to be switched by means of the actuating elements 18 of the push buttons 12.

In order to effect a switching operation of a micro switch 70, the assigned push button 12 needs to be pressed down against the spring forces of the spring legs 32 and 34, until the free end of the actuation element comes into contact with the micro switch 70. Upon releasing the push button 12, it is automatically moved back upwardly in its initial position by means of the spring legs 32 and 34.

Due to the fact, that the push button cap 16 and the actuating element 17 of each push button 12 are formed as a one-piece component, the total number of components is limited. This is very positive in terms of the manufacture, the assembly and the costs of the push button switch assembly 10. Since the actuating element 18 is formed at a position spaced apart from top wall 20 of the push button cap 16, sink marks at the top wall 20 will not be generated during the manufacture of the push button 12.

Thanks to the symmetrical arrangement of the spring legs 32 and 34, a rocking over the diagonal of the top wall 20 of the push button cap 16 is prevented during the manipulation of the push button 12, what is positive in terms of haptics. Due to the restoring force of the spring legs 32 and 34, the ribs 30 formed at the face side of each push button cap 16 and the inner ribs 56 of the frame and the mating slits 28 of each push button cap 16, a very defined and accurate positioning of the push buttons 12 within the frame 12 and with respect to the micro switches 70 of the circuit board 68 is achieved. Also, the push buttons 12 are aligned to each another very well.

Since the ribs 30 of each push button 12 are diagonally displaced, the push buttons can be assembled in either position, i.e. turned by 180°. Push button positioning means, which correspond to the ribs 30 formed at the push buttons 12, can be provided at the short sides at the frame 14, even though not shown.

LIST OF REFERENCE NUMERALS

10 Push button switch assembly
12 Push button
14 Frame
16 Push button cap
18 Actuating element
20 Top wall
22 Bottom wall
24 Sidewall
26 Sidewall
28 Slit
30 Rib
32 Spring leg
34 Spring leg
36 Clamping recess
38 Frame bottom wall
40 Frame sidewall
42 Frame sidewall
44 Frame sidewall
46 Frame sidewall
48 Circumferential edge
50 Fixing means
52 Opening
54 Snap arm
56 Inner rib
58 Outer rib
60 Opening
62 Control panel
64 Guiding structure
66 Housing
68 Circuit board
70 Micro switch

The invention claimed is:

1. Push button switch assembly (10) for insertion in a control panel (62) of a domestic appliance, the push button switch assembly (10) comprising at least one push button (12) and a frame (14) for receiving the at least one push button (12), wherein the push button (12) has a push button cap (16), whose top wall (20) is to be manipulated by a user, and an actuating element (18), in particular an actuating pin, for actuating a switch, especially a micro switch (70), of a circuit board (68) arranged underneath the push button switch assembly (10) upon actuation of the push button cap (16), wherein the push button cap (16) is provided with spring legs (32, 34) resting on a frame bottom (38) and counteracting the actuation of the push button cap (16), wherein at least one pair of spring legs (32, 34) is arranged at a point symmetric or in an axially symmetric arrangement at the push button cap (16), wherein the push button cap (16), the actuating element (18), and the spring legs are formed as a one-piece monolithic component, wherein the spring legs of each pair diverge from a common point of a bottom wall of the push button cap and extend downward in opposed directions such that each pair of spring legs describes an inverted V-shape.

2. Push button switch assembly (10) according to claim 1, characterized in that the actuating element (18) is formed at a position spaced apart from a top wall (20) of the push button cap (16).

3. Push button switch assembly (10) according to claim 1, characterized in that the forces of the spring legs (32, 34), that counteract the actuation of the push button cap (16), are adjustable by material and/or geometry variation.

4. Push button switch assembly (10) according to claim 1, characterized in that ribs (30, 56, 58) are provided at the inside of the frame (14) and/or at the push button cap (16) for fixation or positioning of the push button cap (16).

5. Push button switch assembly (10) according to claim 4, characterized in that the ribs at the frame and the ribs at the push button cap are matched with each other.

6. Push button switch assembly (10) according to claim 1, characterized in that at least a second push button (12) is provided and ribs (30) are asymmetrically arranged at opposite sidewalls of the push button caps (16).

7. Push button switch assembly (10) according to claim 6, characterized in that the asymmetrical arrangement of the ribs (30) is chosen in such a manner that the push button caps (16) can also be assembled in a state rotated by 180°.

8. Push button switch assembly (10) according to claim 6, characterized in that at least two push buttons (12) are arranged in a lengthwise row, wherein push button positioning means, which correspond to the ribs (30) formed at the push buttons (12), are provided at the short sides at the frame (14).

9. Push button switch assembly (10) according to claim 1, characterized in that at each of the length-wise sidewalls (40, 44) of a frame (14) fixing means (50) are configured to enable assembly of the push button switch assembly (10) in an opening (60) of a control panel (62) of a domestic appliance.

10. Push button switch assembly (10) according to claim 1, characterized in that four or at least four spring legs (32, 34) are provided, which are formed in a point symmetric or in an axially symmetric arrangement at the push button cap (16).

11. Push button switch assembly (10) according to claim 1, characterized in that two spring legs (32, 34) are formed at the bottom wall (22) on each of the opposite sides of the actuation element (18) and/or that the spring legs (32, 34) are arranged as at least one pair, wherein the spring legs (32, 34) of each pair extend downwards in opposed directions, respectively, such that each pair of spring legs (32, 34) describes an inverted V-shape.

12. An appliance comprising:

a push button switch assembly for insertion in a control panel of an appliance, the push button switch assembly comprising:

at least one push button;

a frame for receiving the at least one push button, wherein the push button has a push button cap, whose top wall is to be manipulated by a user; and an actuating element, in particular an actuating pin, for actuating a switch, especially a micro switch, of a circuit board arranged underneath the push button switch assembly upon actuation of the push button cap, wherein the push button cap is provided with spring legs resting on a frame bottom and counteracting the actuation of the push button cap, wherein at least two pairs of spring legs is provided, which is arranged at a point symmetric or in an axially symmetric arrangement at the push button cap, wherein the push button cap, the actuating element, and the spring legs are formed as a one-piece monolithic component, wherein the spring legs of each pair diverge from a common point of a bottom wall of the push button cap and extend downward in opposed directions such that each pair of spring legs describes an inverted V-shape.

13. Push button switch assembly for insertion in a control panel of a domestic appliance, the push button switch assembly comprising at least one push button and a frame for receiving the at least one push button, wherein the push button has a push button cap, whose top wall is to be manipulated by a user, and an actuating element, in particular an actuating pin, for actuating a switch, especially a micro switch, of a circuit board arranged underneath the push button switch assembly upon actuation of the push button cap, wherein the push button cap is provided with spring legs resting on a frame bottom and counteracting the actuation of the push button cap, wherein at least one pair of spring legs is provided, which is arranged at a point symmetric or in an axially symmetric arrangement at the push button cap, wherein the push button cap, the actuating element, and the spring legs are formed as a one-piece monolithic component, wherein the spring legs of each pair diverge from a common point of a bottom wall of the push button cap and extend downward in opposed directions such that each pair of spring legs describes an inverted V-shape, wherein the actuating element is formed at a position spaced apart from a top wall of the push button cap, wherein ribs are provided at the inside of the frame and/or at the push button cap for fixation or positioning of the push button cap, wherein the ribs at the frame and the ribs at the push button cap are matched with each other, wherein at least a second push button is provided and ribs are asymmetrically arranged at opposite sidewalls of the push button caps.

* * * * *